United States Patent [19]

Sheffer

[11] Patent Number: 4,646,959

[45] Date of Patent: Mar. 3, 1987

[54] PROMOTIONAL ROUTE TRUCK ASSEMBLY

[75] Inventor: Phil B. Sheffer, New Oxford, Pa.

[73] Assignee: Merchandising Innovations Co., Inc., Hanover, Pa.

[21] Appl. No.: 847,673

[22] Filed: Apr. 3, 1986

[51] Int. Cl.[4] ..... B65D 5/00

[52] U.S. Cl. ..... 229/8; 206/457; 446/73; 446/93; 446/488; D9/308

[58] Field of Search ..... 229/8, 27, 28 R; 446/73, 75–78, 80, 93–95, 488; D9/308, 433; 206/457

[56] References Cited

U.S. PATENT DOCUMENTS

| | | | |
|---|---|---|---|
| 1,547,176 | 7/1925 | Lazaron | 446/77 |
| 1,553,793 | 9/1925 | Rozowsky | 229/8 |
| 2,823,844 | 2/1958 | Frankenstein | 229/8 |
| 3,261,619 | 7/1966 | Norgaard, Jr. et al. | 229/8 |

FOREIGN PATENT DOCUMENTS

| | | | |
|---|---|---|---|
| 904806 | 7/1972 | Canada | 206/457 |
| 1180563 | 6/1959 | France | 229/27 |

*Primary Examiner*—William Price
*Assistant Examiner*—Gary E. Elkins
*Attorney, Agent, or Firm*—Daniel J. O'Connor

[57] ABSTRACT

A display article comprising a promotional route truck assembly which is made entirely of corrugated fiberboard materials. A uniquely engineered series of cuts and score lines permits the article to be shipped in a completely flat or knockdown position. Upon receipt by the retail merchant, consumer or collector, the device may be readily assembled into a highly durable and attractive unit. No separate fasteners or glue of any kind are required for assembly of the unit which may be easily completed even by persons unfamiliar with display assembly techniques. It is contemplated that the device would be suitable for advertising and hobby/collector uses.

5 Claims, 3 Drawing Figures

PROMOTIONAL ROUTE TRUCK ASSEMBLY

Papers relating to the present invention were previously filed under the Disclosure Document Program of the U.S. Patent Office.

BACKGROUND AND OBJECTS OF THE INVENTION

The invention relates generally to display or promotional items which are manufactured of corrugated fiberboard or other easily workable materials.

It would be highly desirable in the advertising and merchandising arts to mass produce attractive advertising articles which may be shipped in a flat or knockdown position and yet easily assembled by the retail merchant.

Accordingly, it is an object of the present invention to mass produce a promotional or collector's article of inexpensive and easily manufactured materials.

It is a further objective to produce an advertising device which may be shipped in large quantities in a knockdown position and be readily assembled by the users thereof into a highly durable and attractive miniature promotional unit.

It is also an object of the present invention to provide a promotional device which has factory formed sections therein such that the device may be easily assembled without the use of separate fastener elements.

It is a further object to provide a collector's item having factory formed sections therein such that the device will be securely retained in its fully assembled position.

It is a still further object to demonstrate a promotional article which may be fabricated of lightweight materials to reduce shipping and warehousing costs in the distribution of such articles.

Further objects and advantages of the present invention will become apparent as the following description proceeds, and the features of novelty characterizing the invention will be pointed out with particularity in the claims annexed to and forming a part of this specification.

In particular, the invention relates to a miniature route truck assembly having the trademarks of a particular beverage manufacturer printed thereon.

In production of the promotional device, a flat sheet of corrugated fiberboard material is die cut into a uniquely engineered design which allows the flat sheet to be readily assembled by the user into a durable and highly attractive display item designed to enhance retail sales of a particular product.

PRIOR ART PATENTS

The most relevant prior art patents presently known to the inventor herein are listed as follows: U.S. Pat. No. 2,823,844 issued to Frankenstein on Feb. 18, 1958; U.S. Pat. No. 953,593 issued to Brown on Mar. 29, 1910; U.S. Pat.No. 4,407,494 issued to Hummel on Oct. 4, 1983; and U.S. Pat. No. 4,055,250 issued to Mayhew on Oct. 25, 1977.

The '844 Frankenstein patent illustrates a particular vehicle folding pattern including wheel cut-out components 71 and 72. The Brown '593 patent also illustrates a foldable miniature vehicle design. The Hummel '494 patent illustrates a corrugated paperboard foldable toy apparatus having plural outer sections 22, 23, 24 attached to a central fuselage element 21. The Mayhew '250 patent illustrates a foldable miniature truck design for use specifically to hold items 16 to be sold.

As will be appreciated from the above patents, the prior art consists of designs which are unnecessarily complex to manufacture and to assemble by the consumer. The prior art designs are further characterized in an end product which is not as sturdy and durable in its intended use as the present invention.

As will be appreciated herein, the present invention combines the desirable features of ease of manufacture, reduced shipping costs, ease of assembly by the consumer, and durability in its intended display usage.

BRIEF DESCRIPTION OF THE DRAWING FIGURES

FULL DESCRIPTION OF THE PREFERRED EMBODIMENT

Figure 1:
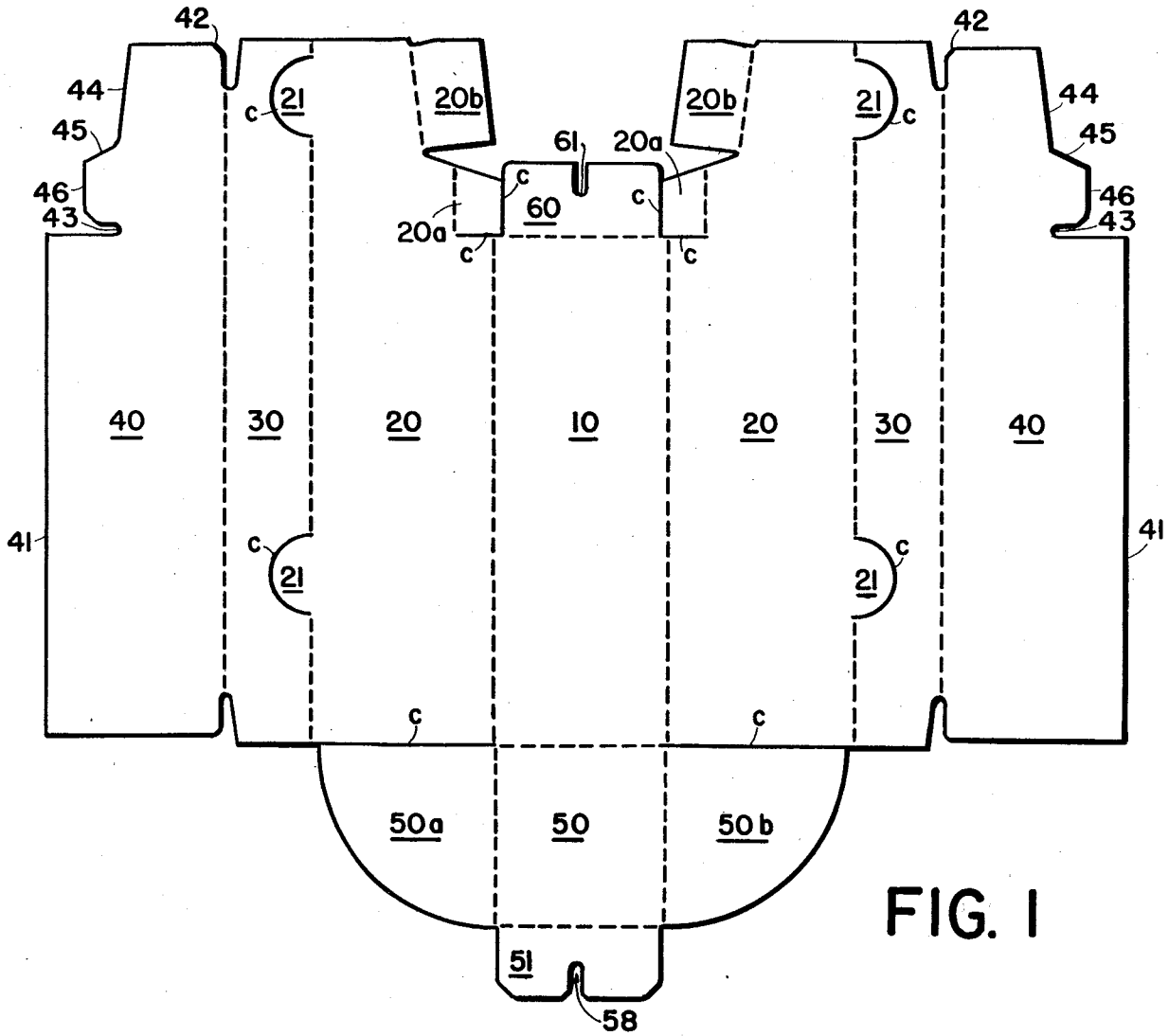
FIG. 1 is a plan view of a flat sheet of corrugated fiberboard having cuts and score lines formed therein in a design which may be folded easily into the shape of a route truck assembly in conjunction with the cab top section of FIG. 2.

Referring now to FIG. 1, the route truck assembly is shown in its flat or knockdown position for shipping purposes.

As shown in its flat position, the corrugated fiberboard has factory applied fold lines shown as dashed lines and factory applied cut through portions shown as solid lines and normally designated by the letter C.

The main sections are shown as defined by dashed score lines therebetween, said score lines allowing a folding of the main sections and attached flaps and tabs relative to each other. The score lines are factory preformed utilizing known steel rule die technology. It should be noted that the solid line sections designated by the letter C represent factory cut through portions to facilitate, for example, the formation of wheel sections 21, flaps 50*a* and 50*b* and tabs 20*a* upon appropriate assembly folding of the device.

The main body portion of the route truck is shown in its flat or knockdown position in FIG. 1 as comprising a rectangular central section 10 which forms the top of the route truck upon assembly, truck side wall sections 20 attached to both sides of central section 10 with score lines formed therebetween, truck bottom wall sections 30 formed outwardly of the side wall sections 20, end panel sections 40 which form a central vertical supporting strut upon assembly.

As further shown in FIG. 1, central section 10 has a truck rear panel section 50 formed on one end thereof, the rear panel section 50 having flaps 50*a* and 50*b* and a slotted tab element 51 formed on the sides thereof.

Figure 2:
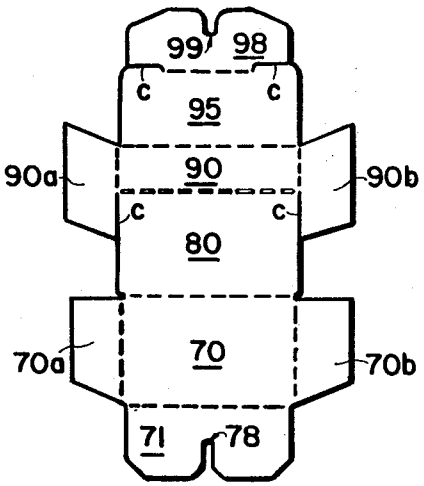
FIG. 2 is a plan view of a flat sheet of corrugated fiberboard formed as a cab top section which constitutes the second piece of the invention structure.
Figure 3:
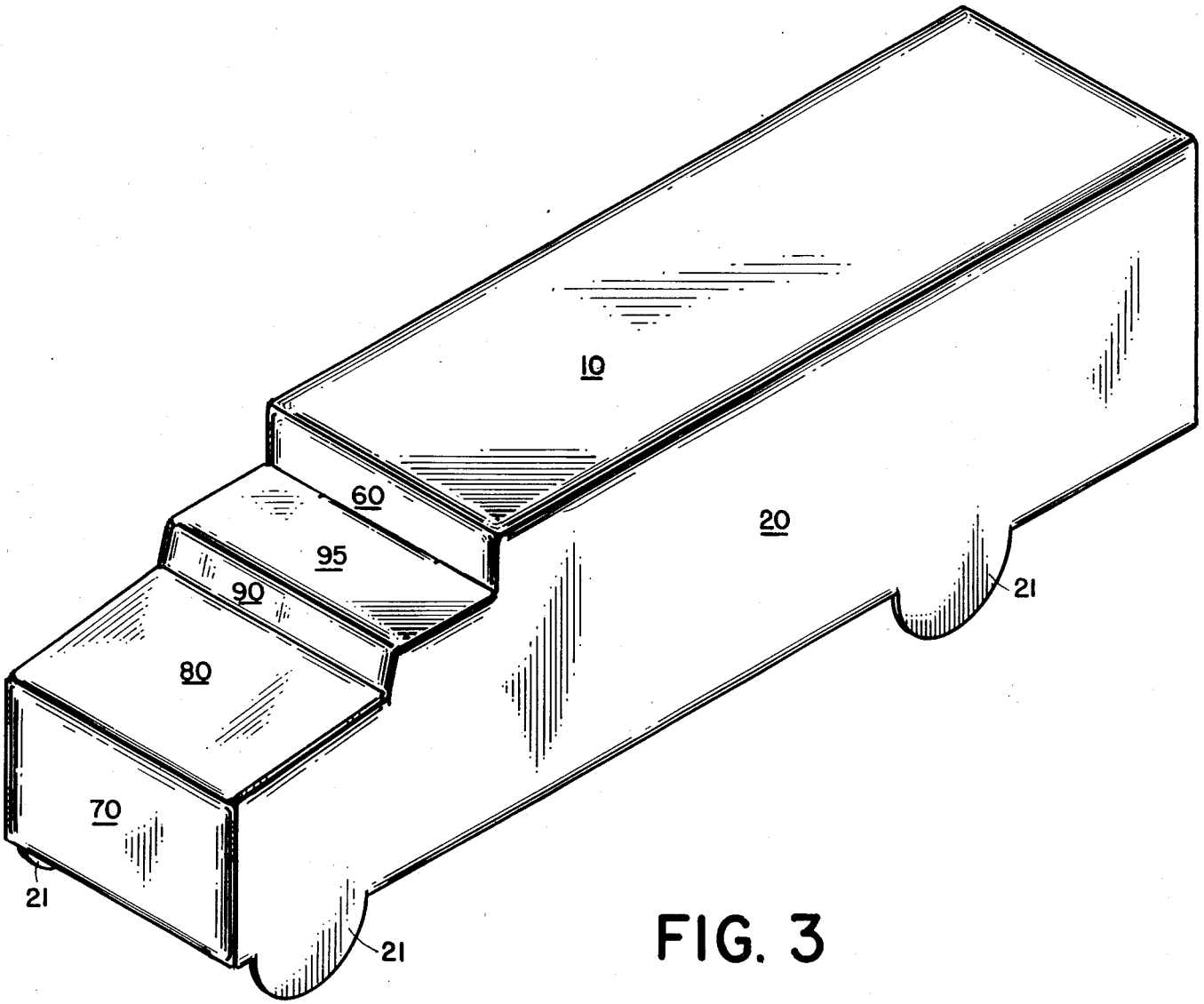
FIG. 3 is a view of the route truck in its assembled condition for display use.

Tabs 20*a* and 20*b* are formed as a part of side wall sections 20 and serve to provide support for the upper cab assembly of FIG. 2 and to provide closure means to give the assembled truck a finished and attractive appearance. A slotted assembly flap 60 is shown on the upper edge of the central section 10.

As shown in FIG. 2, the second piece of the invention, i.e. the upper cab assembly, comprises a rectangular grill panel 70 having flaps 70*a* and 70*b* formed on both lateral sides thereof and a slotted flap means 71 formed along a lower edge. Hood panel 80 is formed along the upper edge of grill panel 70 via the score line therebetween. A windshield panel 90 is formed above the hood panel 80 and has flaps 90*a* and 90*b* on the sides thereof as shown.

The cab top panel 95 is formed above the windshield panel 90 and has a slotted flap means 98 formed on an upper edge thereof.

The unique constructional design may best be illustrated by describing the method of assembly of the route truck of FIGS. 1 and 2.

The two end sections 40 are manually folded inwardly to a position of edge aligned relationship wherein the outer edges 41 are in contact with the inner roof section 10 of the route truck. The score lines shown between main sections 10, 20, 30 and 40 permit the above first folding step.

In this position, an elongated rectangular tube is formed with cut out wheel sections 21 depending therefrom. The two end sections 40 are thus positioned in the middle of the elongated rectangular tube in a vertical position after the above first folding step.

In the next folding steps, flaps 50*a* and 50*b* are folded inwardly ninety degrees as is tab 51. The truck rear panel 50 is then folded inwardly ninety degrees such that flaps 50*a* and 50*b* are positioned interiorly of the truck side walls 20. The slot means 58 formed as a part of tab 51 is then in position to be slid retainably over the vertically positioned end sections 40.

The rear portion of the route truck assembly is thus completed.

The front portion of the truck is assembled by first folding over flap 60 and tabs 20*a* and 20*b* ninety degrees along the score lines shown in FIG. 1.

The upper cab assembly of FIG. 2 is then added by positioning the slot means 78 of flap 71 over the areas 42 of the panels 40.

Grill panel 70 is then folded upwardly such that its flaps 70*a* and 70*b* lie interior of the truck side panels 20. Hood panel 80 and windshield panel 90 are then folded over such that side flaps 90*a* and 90*b* are positioned to the rear of tabs 20*b* and interior of the truck side panels 20.

From this position, cab top panel 95 and its attached flap means 98 are folded over in such manner that the slot means 99 of flap 98 fits into the pocket channel 43 formed in the end panels 40. It should be noted that slot 61 of flap 60 would also have been previously fitted into said pocket channel means 43.

It should also be noted that the perforated score line shown between panels 80 and 90 allows the single outward fold of the assembly, i.e. it permits the windshield panel 90 to be appropriately angled relative to the hood panel 80. The other socre lines shown in the assembly generally permit only an inward fold of their respective adjoining sections.

In the assembled position, hood panel 80 rests on edges 44 of the end panels 40 while windshield panel 90 and cab top panel 95 rest on edges 45 and 46 respectively.

Suitable printed promotional material, such as an advertisement for a particular product, may be applied to the corrugated material in its flattened position before shipping utilizing known printing technology.

It will thus be appreciated by those of skill in the art that an easy to assemble yet durable and attractive miniature route truck promotional aid is achieved by means of the factory cut corrugated fiberboard design.

The flat initial shape of the component parts yields a product which may be shipped flat and therefore distributed to purchasers in a most efficient and cost-effective manner.

The engineered shapes disclosed are of course critical to both the ease of assembly of the device and the durability and attractiveness of the assembled product.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

I claim:

1. A promotional route truck assembly made of manually foldable materials comprising a main body portion and an upper cab assembly, said main body portion comprising a rectangular central section (10), truck side wall sections (20) attached to said central section (10) via score line means therebetween, truck bottom wall sections (30) formed outwardly of said truck side wall sections (20), end panel section means (40) attached to said bottom wall sections via hinge means therebetween and having outer edges opposite said hinge means (41), whereby said outer edges (41) of said end panel section means (40) are in contact with said central section (10) upon assembly of the apparatus, said central section (10) having a rear truck panel section (50) formed on a lower edge thereof, said rear panel section having flaps (50*a*, 50*b*) formed on the sides thereof and further having slotted tab means (51) formed on a lower edge thereof for cooperation with said end panel section means (40) upon assembly of the apparatus, said side wall sections (20) having wheel portions (21) formed as a part thereof, said side wall sections (20) further having tab means (20*a*, 20*b*) formed at a forward edge thereof, said central section (10) further having a slotted flap means (60) formed on an upper edge thereof, wherein said upper cab assembly comprises:

a rectangular grill panel (70) having flap means (70*a*, 70*b*) formed on both lateral sides thereof and a slotted flap means (71) formed on a lower edge thereof, a hood panel (80) formed along an upper edge of said rectangular grill panel (70), a windshield panel (90) formed along an upper edge of said hood panel (80), said windshield panel (90) having flap means (90*a*, 90*b*) formed on the sides thereof, a cab top panel means (95) formed above said windshield panel (90) and having slotted flap means (98) formed on an upper edge thereof, wherein said end panel sections (40) have means (44) for supporting said hood panel (80) upon assembly of the route truck.

2. The apparatus of claim 1 wherein said end panel sections (40) have means (45, 46) for supporting said windshield panel(90) and said cab top panel (95) upon assembly of the route truck.

3. The apparatus of claim 2 wherein said main body portion and said upper cab assembly are comprised entirely of corrugated fiberboard and wherein attachment assembly means are provided therein such that no separate fasteners are required for assembly of the route truck.

4. The apparatus of claim 3 wherein pocket channel means (43) are formed in said end panel section means (40), said pocket channel means (43) being positioned interiorly of said means (46) for supporting said cab top panel (95) and sized so as to cooperatively engage the slotted flap means (98) formed on the upper edge of said cab top panel means (95).

5. The apparatus of claim 4 wherein said end panel section means (40) include forward slotted area means (42) for cooperative engagement with the slotted flap means (71) formed on a lower portion of said grill panel (70).

* * * * *